US006697598B2

(12) United States Patent
Hauptmann

(10) Patent No.: US 6,697,598 B2
(45) Date of Patent: Feb. 24, 2004

(54) HEATING AT LEAST ONE MATERIAL LAYER, WITH ELECTROMAGNETIC AND/OR ACOUSTIC WAVES AT AN ANGLE OF INCEDENCE SO THAT HEATING TAKES PLACE AT LEAST PREDOMINANTLY VIA THE QUANTUM TUNNEL EFFECT

(75) Inventor: Gerald Erik Hauptmann, Bammental (DE)

(73) Assignee: NexPress Solutions LLC, Rochester, NY (US)

( * ) Notice: Subject to any disclaimer, the term of this patent is extended or adjusted under 35 U.S.C. 154(b) by 0 days.

(21) Appl. No.: 10/023,553

(22) Filed: Dec. 18, 2001

(65) Prior Publication Data

US 2002/0094219 A1 Jul. 18, 2002

(30) Foreign Application Priority Data

Dec. 22, 2000 (DE) ..... 100 64 557

(51) Int. Cl.[7] ..... G03G 15/20
(52) U.S. Cl. ..... 399/336; 219/216
(58) Field of Search ..... 399/67, 320, 335, 399/336, 337; 219/216; 347/156; 430/124

(56) References Cited

U.S. PATENT DOCUMENTS

| | | | | | |
|---|---|---|---|---|---|
| 3,566,076 | A | * | 2/1971 | Fantuzzo et al. | 219/216 |
| 3,655,280 | A | * | 4/1972 | Zoppoth | 399/337 |
| 4,456,368 | A | * | 6/1984 | Isaka et al. | 399/336 |
| 4,482,239 | A | * | 11/1984 | Hosono et al. | 399/336 |
| 4,511,778 | A | * | 4/1985 | Takahashi et al. | 399/336 X |
| 5,390,013 | A | | 2/1995 | Snelling | |

FOREIGN PATENT DOCUMENTS

| | | | |
|---|---|---|---|
| DE | 32 07 985 A1 | | 9/1983 |
| DE | 44 07 931 C2 | | 2/1996 |
| JP | 2000-131976 | * | 5/2000 |

* cited by examiner

*Primary Examiner*—Sandra Brase
(74) *Attorney, Agent, or Firm*—Lawrence P. Kessler

(57) ABSTRACT

A process for heating at least one second material layer (2), especially a toner layer which has been transferred to an image receiver substrate. Energy delivery from electromagnetic and/or acoustic waves (5) is incident from a first material layer (1) at an angle of incidence ($\alpha$) relative to the normal (7) of the second material layer (2). The angle of incidence ($\alpha$) is chosen such that the energy delivery which causes at least the heating of the second material layer (2) takes place at least predominantly via the quantum tunnel effect.

9 Claims, 1 Drawing Sheet

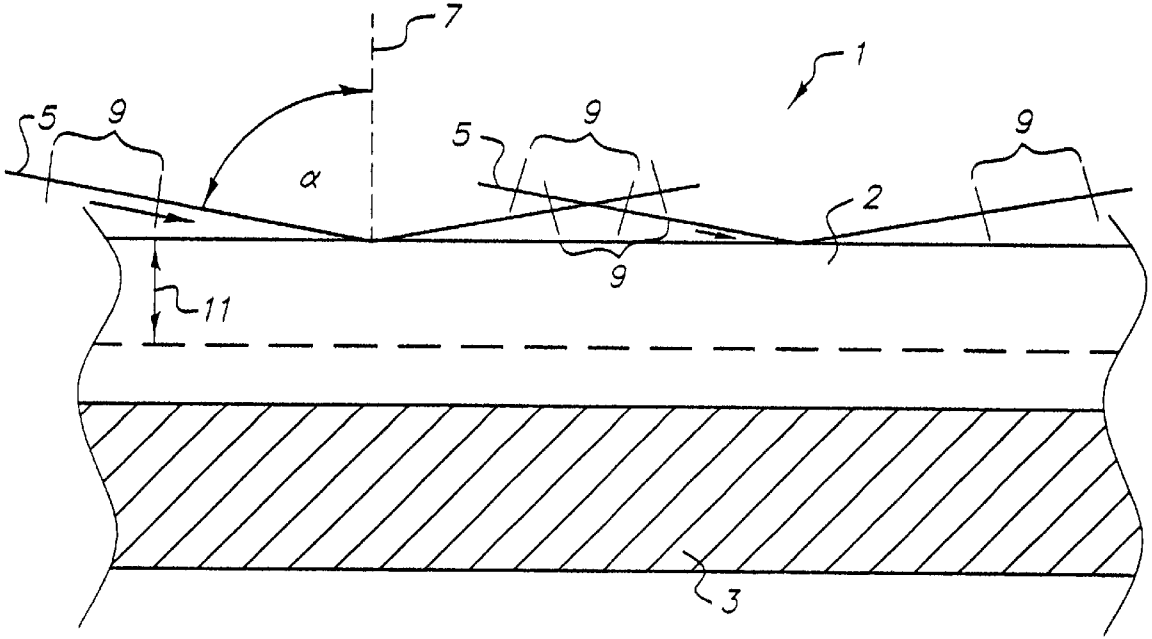
FIGURE

HEATING AT LEAST ONE MATERIAL LAYER, WITH ELECTROMAGNETIC AND/OR ACOUSTIC WAVES AT AN ANGLE OF INCEDENCE SO THAT HEATING TAKES PLACE AT LEAST PREDOMINANTLY VIA THE QUANTUM TUNNEL EFFECT

FIELD OF THE INVENTION

The invention relates to heating at least one second material layer, especially a toner layer which has been transferred to an image receiver substrate, wherein heating of at least the second material layer takes place predominately via the quantum tunnel effect.

BACKGROUND OF THE INVENTION

One known printing process is electrostatic printing in which a latent electrostatic image is developed by charged toner particles. The latter are transferred to an image receiver substrate which is hereinafter also called a substrate for short. Then the developed image which has been transferred to the substrate is fixed by the toner particles being warmed or heated and melted. Optionally the substrate can also be heated. To melt the toner particles, contact methods are often used, in which the toner particles are brought into contact with the corresponding mechanisms, for example hot rollers or drums. The disadvantage here is that building and maintaining the contact-making heating mechanisms are complex and thus operating costs are high. Moreover, the use of silicone oil as the separating agent which is designed to prevent adhesion of the melted toner to the heating mechanisms is necessary. Furthermore, the fault rate caused by the contact-making heating mechanisms is relatively high.

To eliminate these disadvantages, processes have been suggested in which toner particles are heated or melted using electromagnetic or acoustic waves, so that they stick to the substrate, for example, paper.

In conjunction with the use of electromagnetic or acoustic waves however the problem arises that it is very difficult to control the penetration depth of the waves into the toner layer and optionally the image receiver substrate, regardless of the material properties. At the conventionally used angles of incidence of the electromagnetic or acoustic waves the penetration depth is in the range between a few multiples of the wavelengths and some dozens of the wavelength. But the penetration depth for the entire heating or toner melting process plays a decisive role and for example influences the image quality of one-page printouts, the frequency of reproduction problems on the pages printed second in duplex printing, the glossiness and the gloss differences of the printouts, the adhesion properties of the toner layer fixed on the image receiver substrate, (unwanted) bubble formation, possible shrinkage of the image receiver substrate and so forth.

SUMMARY OF THE INVENTION

Therefore the object of the invention is to devise a process of the initially mentioned type with which the penetration depth of the electromagnetic and/or acoustic waves into a second material which is to be heated, especially a toner layer, and/or a third material layer, especially an image receiver substrate and/or an image receiver substrate carrier, can be controlled, regardless of the properties of the individual material layers. A further object of the invention is to control the amount of energy delivered to at least the second material layer by the electromagnetic and/or acoustic waves, especially without changing the radiation intensity of the wave source and regardless of the reflection properties of the third layer.

To achieve this object, a process is used especially to heat a second material layer in the form of a toner layer which has been transferred to the image receiver substrate, by delivering energy from electromagnetic and/or acoustic waves. The electromagnetic and/or acoustic waves are incident from a layer which can be formed for example by air, at an angle of incidence a relative to the normal of the second material layer. It is known to one skilled in the art, for example from physics textbooks, that at an angle of incidence in the region of 90°, the reflected part of an electromagnetic or acoustic wave which on the interface strikes the second material layer, with a higher index of refraction, is roughly 100%. If the second material layer has a lower index of refraction than the first material layer, similar conditions arise when the angle of incidence a corresponds to the so-called boundary angle of total reflection. Under these conditions the energy delivery by the normally-refracted wave portion which penetrates the second material layer is negligibly small. The penetration depth of this wave portion is therefore almost meaningless. The invention is characterized in that the angle of incidence a is chosen such that the energy delivery which causes at least the heating of the second material layer takes place at least predominantly via the quantum tunnel effect. The use of this quantum tunnel effect for heating at least one second material layer makes it possible to control the penetration depth of electromagnetic and/or acoustic waves into the second material layer exclusively via the wavelength used, regardless of the material properties, by which for example the above mentioned problems can be eliminated.

Since the quantum tunnel effect is sufficiently known to one skilled in the art, for example from physics textbooks, it is described only briefly here. When an electromagnetic or acoustic wave is incident on the interface between the first material layer and the second material layer with a higher index of refraction at an angle of incidence of roughly 90° to the normal of the interface, the reflected portion of the waves is almost 100%. Under these conditions the energy delivery by the normally-refracted wave portion which penetrates into the second material layer is negligible small, for which reason its penetration depth no longer plays a part. But as a result of the quantum tunnel effect the incident waves upon reflection on the interface penetrate into the second material layer with a penetration depth which corresponds roughly to the wavelength of the electromagnetic or acoustic waves. This penetration depth of roughly one wavelength is essentially independent of the material properties of the second material layer. The path traversed when the waves are reflected in the second material layer is arc-shaped and corresponds likewise to roughly one wavelength. The energy is absorbed along this traversed path and depends on the absorption properties of the second material layer and optionally other material layers into which the waves penetrate upon reflection, based on the quantum tunnel effect. Thus the invention is based on the finding that the penetration depth can be decoupled from the amount of absorption, the amount of power delivered however depending furthermore on the amount of absorption and the absorption properties of the second material layer and optionally the other material layers.

Depending on what proportion the energy delivered into the second layer as a result of normal refraction of the waves is to have relative to the energy delivered via the quantum tunnel effect, the angle of incidence α can be in the range from 60° to 90°. But it is preferred that the angle of incidence α is in the region of 90°.

In the process of the invention, it is preferred that there is a second material layer on the third material layer, especially an image receiver substrate. For example, if a toner layer is to be fixed, the wavelength of the electromagnetic and/or acoustic waves can be chosen such that it is somewhat larger than the layer thickness of the second material layer, so that optionally also the image receiver substrate, for example paper or cardboard, can be heated to the desired amount. In some cases this benefits the result of the fixing process.

In general, in the process of the invention, it holds that the wavelength of the electromagnetic and/or acoustic waves is set to a value which corresponds roughly to the penetration depth with which the electromagnetic and/or acoustic waves are to penetrate at least into the second material layer, as is detailed below using the accompanying drawing.

As mentioned, the path traversed by the electromagnetic and/or acoustic waves upon reflection in the second material layer is relatively short and likewise corresponds to roughly one wavelength. In some cases therefore the problem can arise that the energy which has been absorbed in the second material layer and which causes heating is not high enough to produce the desired temperatures. To the extent this problem becomes relevant, the process according to the invention can provide that at least parts of the electromagnetic and/or acoustic waves are repeatedly guided using reflection over or onto the second material layer in order to increase or influence the energy delivery achieved overall, regardless of the intensity of the electromagnetic and/or acoustic waves.

Since the wavelength of the electromagnetic and/or acoustic waves used according to the basic idea of this invention is already fixed by the desired penetration depth, the wavelength cannot be adapted as usual to the absorption properties of the material layers used. Therefore, the case can arise that at least some of the material layers have a very low absorption coefficient for the wavelength which is to be used. For example, in conjunction with fixing the toner this can lead to a nonoptimum melting process. If the problem arises, the process according to the invention can provide that at least the second material layer has components which in the region of the wavelength of the electromagnetic and/or acoustic waves have a high absorption capacity. To the extent the second material layer is the toner layer, these components can be formed for example by suitable additives which are mixed with the conventional toner components. To this extent heating of the third material layer, for example the image receiver substrate, is desired, this material layer can also have the corresponding suitable components.

In order to be able to adjust the energy delivered into at least the second material layer if necessary regardless of the adjusted wavelength of the electromagnetic and/or acoustic waves, the intensity and optionally the reflection, in some embodiments of the process of the invention it can be provided that the ratio of the portion of the energy which has been delivered via the quantum tunnel effect into at least the second material layer, to the portion of the energy which is delivered via conventional refraction, is set via the angle of incidence α. The energy portion delivered by conventional refraction in this connection is defined as the energy portion which is delivered by nonreflected waves.

For example, when the second material layer is formed by a toner layer and the third material layer is formed by paper, the second material layer includes particles and the third material layer includes fibers, i.e. they are nonhomogeneous materials. As a result of surface irregularities these materials can cause diffuse reflection of the electromagnetic and/or acoustic waves, by which the efficiency of the process as claimed in the invention can be reduced under certain circumstances in an undesirable manner. If this problem occurs, the process according to the invention can provide that the second material layer and/or the third material layer are conditioned before heating such that the extent of the diffuse reflection of the electromagnetic and/or acoustic waves at the transitions between the material layers is at least limited. In the case of paper and toner this conditioning can comprise for example compaction, for example by applying pressure.

One especially preferred embodiment of the process according to the invention calls for the second material layer to be a toner layer which is to be fixed and which is applied to an image receiver substrate which forms the third material layer, and for one or more of the following properties of the toner layer to be influenced via the intensity and/or the wavelength of the electromagnetic and/or acoustic waves: homogeneity, adhesion properties with respect to the image receiver substrate, and/or bubble formation.

To achieve the aforementioned object, the invention furthermore proceeds from a device for heating the second toner layer, especially for fixing a toner layer which has been transferred to the image receiver substrate. The device has at least one wave source for generating electromagnetic and/or acoustic waves which heat at least the second material layer, especially a toner layer, by delivering energy. At least one wave source is aligned such that the electromagnetic and/or acoustic waves are incident from the first material layer at an angle of incidence α relative to the normal of the second material layer when the latter is heated. The device of the invention is characterized by the angle of incidence α being chosen such that the energy delivery which causes at least heating of the second material layer takes place at least predominantly via the quantum tunnel effect. With one such device similar advantages are achieved as were already explained for the process of the invention.

BRIEF DESCRIPTION OF THE DRAWINGS

In the detailed description of the preferred embodiment of the invention presented below, reference is made to the accompanying drawings, in which the single FIGURE shows, in cross-section, a substrate and multiple material layers associated therewith, and incident angles for the electromagnetic or acoustic waves of energy delivered according to this invention.

DETAILED DESCRIPTION OF THE INVENTION

As shown in the FIGURE, the first material layer 1 is formed by air or a suitable coupling medium. The second material layer 2 is formed by the toner material layer which is to be fixed and which is located on the image receiver substrate 3, for example, paper, which forms the third material layer 3. Electromagnetic and/or acoustic waves 5 are incident at an angle of incidence a to the normal 7 of the second material layer 2. The angle of incidence a is preferably almost 90°. The wavelength 9 in the FIGURE is shown by the corresponding sections of the lines which illustrate the electromagnetic and/or acoustic waves 5. In this case energy is delivered to the second material layer 2 almost solely via the quantum tunnel effect. As already mentioned, the penetration depth 11 therefore corresponds roughly to the wavelength 9 of the electromagnetic and/or acoustic waves 5.

According to the FIGURE, the wavelength 9 is chosen such that the penetration depth 11 is somewhat less than the layer thickness of the second material layer 2, so that the third material layer 3 formed by the image receiver substrate is not directly heated. The third material layer 3 is heated in this case solely by heat conduction. In certain cases it can be advantageous if the wavelength 9 of the electromagnetic and/or acoustic waves 5 is chosen such that the penetration depth 11 extends into the third material layer 3, for example roughly to its middle. Especially in such case, the toner which forms the second material layer 2 and/or the image receiver substrate which forms the third material layer 3 can contain additives to improve the absorption properties of the second material layer 2 and/or the third material layer 3 or to adapt to the wavelength 9. It can optionally be provided that energy is also delivered to other layers which are not shown.

The embodiments should not be understood as a limitation of the invention. Rather, within the framework of this disclosure numerous modifications and changes are possible, especially those versions, elements and combinations and/or materials which for example by combination or modification can be taken from individual features or elements for process steps which are contained in the drawings and which are described in the general specification and embodiments and the claims, for one skilled in the art with respect to achieving the object, and which lead to a new subject matter or new process steps or sequences of process steps by combinable features.

PARTS LIST

1 first layer
2 second layer
3 third layer
5 waves
7 normal
9 wavelength
11 penetration depth

What is claimed is:

1. Process for heating at least a toner material layer on an image receiver substrate, by energy from electromagnetic and/or acoustic waves (5), the electromagnetic and/or acoustic waves (5) being incident at an angle of incidence (α) relative to the normal (7) of the toner material layer (2), comprising the steps of:

choosing the angle of incidence (α) such that the energy from the electromagnetic and/or acoustic waves, which causes the heating of the toner material layer (2), takes place at least predominantly via the quantum tunnel effect.

2. Process as claimed in claim 1, wherein the angle of incidence (α) is in the range from 60° to 90°.

3. Process as claimed in claim 2, wherein the angle of incidence (α) is in the region of 90°.

4. Process as claimed in claim 1, wherein the wavelength (9) of the electromagnetic and/or acoustic waves (5) is set to a value which corresponds roughly to a penetration depth (11) with which the electromagnetic and/or acoustic waves energy (5) penetrates at least into the toner layer (2).

5. Process as claimed in claim 1, wherein at least parts of the electromagnetic and/or acoustic waves (5) are repeatedly reflected over or onto the toner material layer (2) in order to influence the energy delivery achieved overall, regardless of the intensity of the electromagnetic and/or acoustic waves energy (5).

6. Process as claimed in claim 1, wherein the region of the wavelength (9) of the electromagnetic and/or acoustic waves (5) is selected so as to correspond to high absorption capacity components of at least the toner material layer (2).

7. Process as claimed in claim 1, wherein the ratio of the portion of electromagnetic and/or acoustic wave energy which is delivered via the quantum tunnel effect into the toner material layer (2) to the portion of electromagnetic and/or acoustic wave energy which is delivered via conventional refraction, is set via the angle of incidence (α).

8. Process as claimed in claim 1, wherein the second material layer (2) and/or the substrate material layer (3) are conditioned before heating such that the extent of the diffuse reflection of the electromagnetic and/or acoustic waves (5) at the transitions between the material layers (2, 3,) is at least limited.

9. Process as claimed in claim 1, wherein the second material layer (2) is a toner layer which is to be fixed and which is applied to an image receiver substrate material layer (3), and wherein one or more of the following properties of the toner material layer is influenced via the intensity and/or the wavelength (9) of the electromagnetic and/or acoustic waves (5): homogeneity, adhesion properties with respect to the image receiver substrate, bubble formation.

* * * * *